US011142000B2

(12) United States Patent
Gunji

(10) Patent No.: US 11,142,000 B2
(45) Date of Patent: Oct. 12, 2021

(54) PRINTING APPARATUS, LEARNING DEVICE, AND LEARNING METHOD

(71) Applicant: SEIKO EPSON CORPORATION, Tokyo (JP)

(72) Inventor: Hiroyuki Gunji, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/743,144

(22) Filed: Jan. 15, 2020

(65) Prior Publication Data

US 2020/0230981 A1 Jul. 23, 2020

(30) Foreign Application Priority Data

Jan. 18, 2019 (JP) ..... JP2019-006671

(51) Int. Cl.

| | |
|---|---|
| ***B41J 13/00*** | (2006.01) |
| ***B41J 11/42*** | (2006.01) |
| *B65H 16/10* | (2006.01) |
| *B41J 11/44* | (2006.01) |
| *B41J 11/00* | (2006.01) |

(52) U.S. Cl.

CPC ..... *B41J 13/0009* (2013.01); *B41J 11/42* (2013.01); *B41J 11/425* (2013.01); *B41J 11/00* (2013.01); *B41J 11/44* (2013.01); *B65H 16/10* (2013.01); *B65H 16/103* (2013.01); *B65H 16/106* (2013.01)

(58) Field of Classification Search

CPC ..... B41J 13/0009; B41J 11/42; B41J 11/425; B41J 11/44; B41J 11/00; B41J 29/38; B65H 16/10; B65H 16/103; B65H 16/106

See application file for complete search history.

(56) References Cited

U.S. PATENT DOCUMENTS

| | | | | |
|---|---|---|---|---|
| 2011/0018926 | A1* | 1/2011 | Sasaki | B41J 13/0009 347/16 |
| 2016/0121629 | A1 | 5/2016 | Ipponyari et al. | |
| 2017/0308049 | A1 | 10/2017 | Fujii et al. | |

FOREIGN PATENT DOCUMENTS

| | | |
|---|---|---|
| JP | 2009-256095 | 11/2009 |
| JP | 2014-100793 | 6/2014 |
| JP | 2016-087903 | 5/2016 |
| JP | 2017-199074 | 11/2017 |

* cited by examiner

*Primary Examiner* — Henok D Legesse
(74) *Attorney, Agent, or Firm* — Workman Nydegger

(57) ABSTRACT

A printing apparatus provided with a transportation mechanism for a printing medium includes: a storage configured to store a machine-learned model that outputs a setting value of the transportation mechanism for causing, based on state variables including a print length as a length of a print product printed on the printing medium, the print length to be close to a reference; and a processor configured to perform printing by controlling the transportation mechanism in accordance with the setting value acquired based on the machine-learned model.

6 Claims, 7 Drawing Sheets

PRINTING APPARATUS, LEARNING DEVICE, AND LEARNING METHOD

The present application is based on, and claims priority from JP Application Serial Number 2019-006671, filed Jan. 18, 2019, the disclosure of which is hereby incorporated by reference herein in its entirety.

BACKGROUND

1. Technical Field

The present disclosure relates to a printing apparatus, a learning device, and a learning method.

2. Related Art

In a printing apparatus, it is important that printing is performed with an expected print size based on image data for printing a print product. That is, in a printing apparatus configured to perform printing while transporting a printing medium in a specified direction, print quality is degraded when a print length, which is a length of a print product in a transportation direction of the printing medium, is not accurately controlled. For example, when the print length is longer than a reference length based on image data to be printed, discontinuous marks (white streaks) are produced in portion to be continuously printed in the transportation direction of the printing medium. When the print length is shorter than the reference length, the portions to be continuously printed in the transportation direction of the printing medium are overlapped, thereby black streaks being produced.

Techniques for bringing a print length in the transportation direction of a printing medium close to a reference length have been developed; for example, JP-A-2009-256095 discloses a technique in which a tensile force applied to a printing medium is so controlled as to be equal to or smaller than a predetermined value.

However, it may be difficult to precisely correct a setting value of a transportation mechanism in accordance with aging deterioration of rollers, characteristics of a printing medium, and an environment of usage even when the technique of related art is used.

SUMMARY

In order to solve at least one of the above problems, a printing apparatus having a transportation mechanism for a printing medium includes: a storage configured to store a machine-learned model that outputs a setting value of the transportation mechanism for causing, based on state variables including a print length as a length of a print product printed on the printing medium, the print length to be close to a reference; and a processor configured to perform printing by controlling the transportation mechanism in accordance with the setting value acquired based on the machine-learned model. With this configuration, it is possible to control the transportation mechanism by the setting value of the transportation mechanism optimized in accordance with the state of the print length, and it is also possible to maintain the print length in a state close to the reference for a long time.

Further, learning of the machine-learned model may be carried out in a manner in which the state variables including the print length are observed; an action for changing the setting values including at least one of values of a pressure for pinching the printing medium with a transportation roller configured to pinch and transport the printing medium, a tensile force to be applied to the printing medium transported by the transportation mechanism, a frequency of detection of the tensile force performed for controlling the tensile force, and an attachment force of an attachment unit for attaching the printing medium to a predetermined position, is determined based on the observed state variables; and the setting values are optimized based on a shift of the print length from the reference. That is, by learning the machine-learned model by reinforcement learning, it is possible to easily define an optimum setting value of the transportation mechanism so as to bring the print length close to the reference.

Further, the learning of the machine-learned model may be carried out in a manner in which, based on a reward which becomes larger as the shift of the print length from the reference is smaller, the setting values are optimized by iterating the observation of the state variables, the determination of the action in accordance with the state variables, and evaluation of the reward obtained by the action. According to this configuration, by learning the machine-learned model by the reinforcement learning, it is possible to easily define the optimum setting value of the transportation mechanism so as to bring the print length close to the reference.

Further, the state variables may include at least one of temperature and humidity around the printing apparatus. According to this configuration, even when the surrounding environment of the printing apparatus is changed, it is possible to maintain the state in which the printing length is close to the reference.

Further, the machine-learned model may be learned for each type of the printing medium. According to this configuration, it is possible to acquire a setting value of the transportation mechanism suitable for each printing medium type.

A learning device of a machine-learned model referred to in a printing apparatus that is provided with a transportation mechanism for a printing medium may be configured to include a learning unit configured to acquire a model, as a machine-learned model, that outputs a setting value of the transportation mechanism for causing, based on state variables including a print length as a length of a print product printed on the printing medium, the print length to be close to a reference. That is, the present disclosure may also be applicable to a learning device of a machine-learned model that outputs a setting value of the transportation mechanism.

DESCRIPTION OF EXEMPLARY EMBODIMENTS

Figure 1:
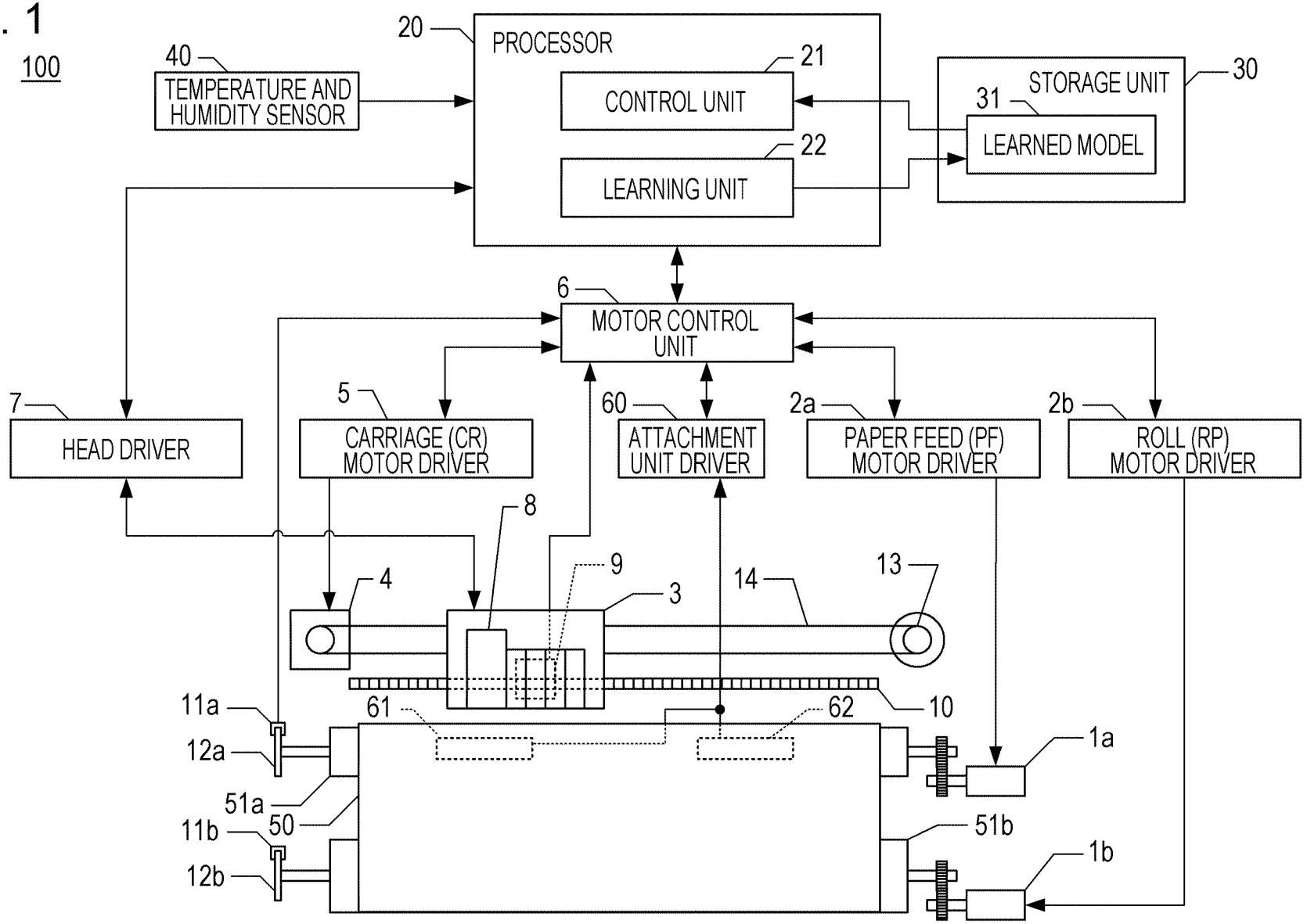
FIG. 1 is a diagram illustrating a configuration of a printing apparatus.

Hereinafter, embodiments of the present disclosure will be described in the following order with reference to the accompanying drawings. The corresponding constituent elements in the drawings are denoted by the same reference numerals, and redundant description thereof will be omitted.

1. Configuration of Printing Apparatus and Learning Device

2. Determination of Setting Value of Transportation Mechanism 2-1. Learning of Machine-learned model 2-2. Example of Learning of Transportation Mechanism Setting Value 3. Printing Process 4. Other Embodiments

1. Configuration of Printing Apparatus and Learning Device

FIG. 1 is a block diagram illustrating a schematic configuration of a printing apparatus and a learning device according to an embodiment of the present disclosure. A printing apparatus 100 illustrated in FIG. 1 includes a paper feed motor (hereinafter, also referred to as PF motor) 1*a* for feeding out paper, a PF motor driver 2*a*, a roll 51*b* (hereinafter, also referred to as RP) for accumulating a printing medium, an RP motor 1*b* for rotating the roll 51*b*, an RP motor driver 2*b*, a carriage 3, a carriage motor (hereinafter, also referred to as CR motor) 4, a CR motor driver 5, attachment units 61 and 62 configured to attach a printing medium 50 to a platen, an attachment unit driver 60, a head driver 7, and a motor control unit 6.

The printing apparatus 100 further includes a camera 8, a (linear) encoder 9, a (linear) encoder coded plate 10, (rotary) encoders 11*a* and 11*b*, (rotary) encoder coded plates 12*a* and 12*b*, a pulley 13, a timing belt 14, a processor 20, a storage unit 30, a temperature and humidity sensor 40, and a PF roller 51*a* (transportation roller) for transporting the printing medium 50. Needless to say, in FIG. 1, other constituent elements that may be included in the printing apparatus 100 are omitted; for example, a pump for controlling ink suction to prevent clogging of the head may be provided.

Figure 2:
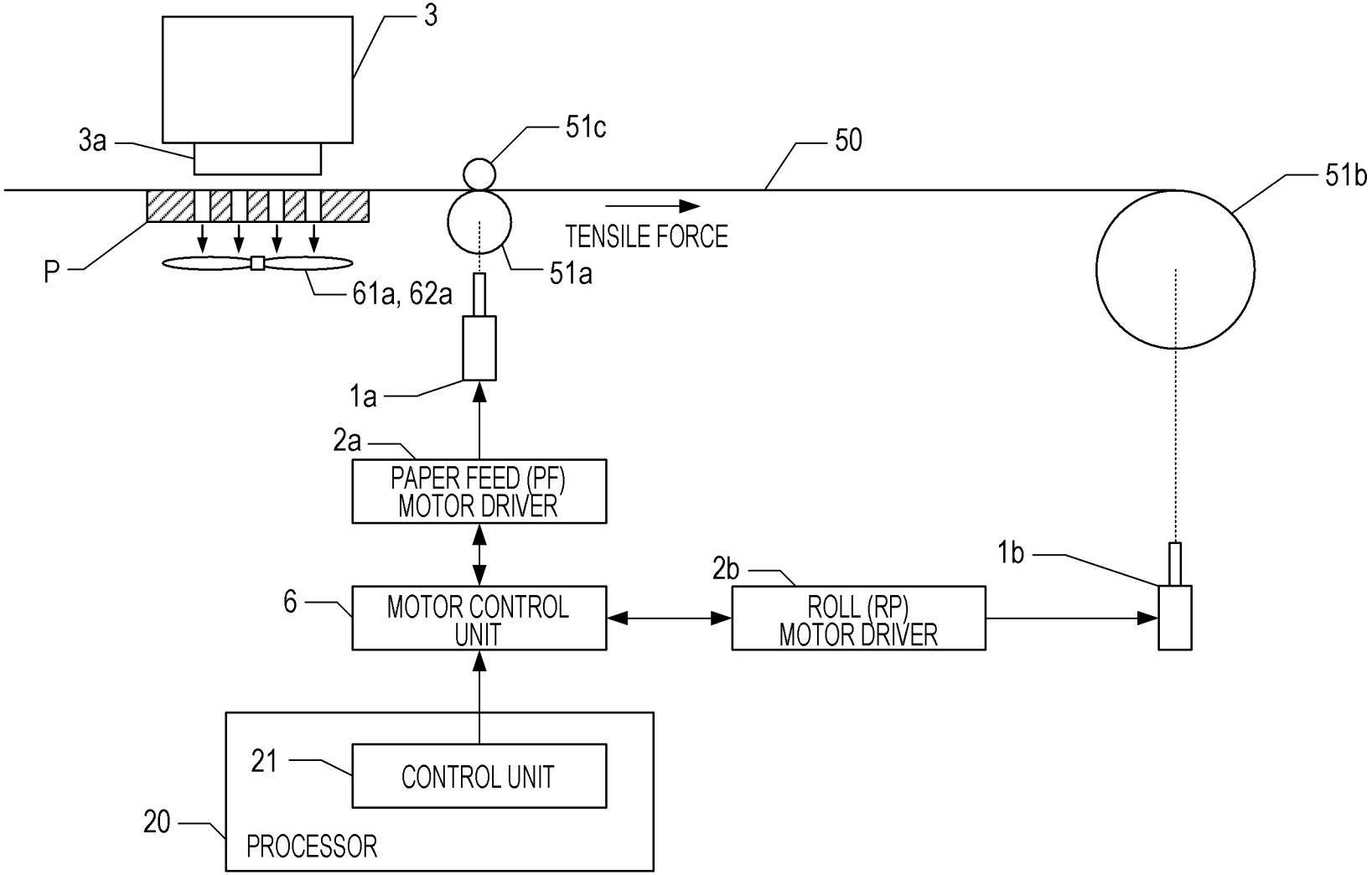
FIG. 2 is a diagram schematically illustrating a configuration of a printing apparatus when viewed from an axial direction of a PF roller.

The temperature and humidity sensor 40 outputs information indicating the temperature and humidity around the printing apparatus 100. In this embodiment, the PF motor 1*a* is driven to rotate by the PF motor driver 2*a*. When the PF motor 1*a* rotates, the PF roller 51*a* is rotated via a gear or the like to transport the printing medium 50. FIG. 2 is a diagram schematically illustrating a configuration of the printing apparatus 100 when viewed from an axial direction of the PF roller 51*a*. As illustrated in FIG. 2, the printing medium 50 is pinched between the PF roller 51*a* and a driven roller 51*c*, and in this state, the PF roller 51*a* rotates to transport the printing medium 50, which is accumulated on the roll 51*b*, from right to left in FIG. 2.

The RP motor 1*b* is driven to rotate by the RP motor driver 2*b*. When the RP motor 1*b* rotates, the roll 51*b* is rotated via a gear or the like, so that the printing medium 50 is supplied from the roll 51*b* to the PF roller 51*a* side. As described above, in the present embodiment, since both the PF roller 51*a* and the roll 51*b* are driven to rotate, it is possible to adjust a tensile force applied to the printing medium 50 existing between the PF roller 51*a* and the roll 51*b* by adjusting torque acting on each thereof.

The CR motor 4 is driven to rotate by the CR motor driver 5. When the CR motor 4 rotates forward and backward, the carriage 3 is reciprocated in a straight-line direction via the timing belt 14. The carriage 3 is provided with a head 3*a* as illustrated in FIG. 2, and ink droplets of a plurality of ink colors are ejected under the control of the head driver 7, whereby printing is performed on the printing medium 50.

As described above, in the present embodiment, printing can be performed in a two-dimensional range of the printing medium, by making use of the reciprocating movement in the straight-line direction of the carriage 3 and the transportation of the printing medium done by the PF roller 51*a*. In the present embodiment, the moving direction of the carriage 3 is referred to as a main scanning direction, and the moving direction of the printing medium by the PF roller 51*a* is referred to as a sub scanning direction. In the present embodiment, the main scanning direction and the sub scanning direction are perpendicular to each other.

The attachment unit driver 60 generates electric power for driving the attachment units 61 and 62, and supplies the electric power to the attachment units 61 and 62 to drive them. The attachment units 61 and 62 are provided with fans 61*a* and 62*a* respectively, as illustrated in FIG. 2. The fans 61*a* and 62*a* are driven by the electric power supplied from the attachment unit driver 60, and when the fans 61*a* and 62*a* rotate, the printing medium 50 is attached to a platen P. As a result, the printing medium 50 is transported in the transportation direction in a state of being attached to the platen P.

The head driver 7 generates a voltage to be applied to the head 3*a* provided in the carriage 3, and controls a voltage supply to each head 3*a*. When a voltage is supplied to each head 3*a*, ink droplets corresponding to the voltage are ejected to perform printing on the printing medium.

In this embodiment, the carriage 3 is provided with the camera 8. The camera 8 includes a light source (not illustrated) and a sensor (not illustrated), and is able to acquire an image on the printing medium 50 in a state in which the printing medium 50 is illuminated by the light source. Since the camera 8 is mounted in the carriage 3, it is possible to acquire an image at any position in the main scanning direction by moving the carriage 3. In addition, according to the image on the printing medium 50, it is possible to distinguish a portion where printing is performed on the printing medium 50 from a portion where printing is not performed. In this embodiment, the length of an image printed on the printing medium 50 from the print start position to the print end position in the sub scanning direction, which is the transportation direction of the printing medium 50, is referred to as a print length.

The motor control unit 6 includes a circuit configured to output a DC current command value to the PF motor driver 2*a*, the RP motor driver 2*b*, and the CR motor driver 5. The PF motor driver 2*a* drives the PF motor 1*a* to rotate with a current value corresponding to the DC current command value. The RP motor driver 2*b* drives the RP motor 1*b* to rotate with a current value corresponding to the DC current command value. The CR motor driver 5 drives the CR motor 4 to rotate with a current value corresponding to the DC current command value.

The encoder coded plate 10 is an elongated member having slits formed at predetermined intervals, and is fixed in the printing apparatus 100 to be parallel to the main scanning direction. The encoder 9 is fixed at a position in the carriage 3 corresponding to the encoder coded plate 10. The encoder 9 outputs pulses corresponding to the number of slits having crossed the encoder 9 as the carriage 3 moves, thereby outputting information indicating the position of the carriage 3.

The encoder coded plates 12*a* and 12*b* are thin-plate circular members, have slits formed in a radial direction at predetermined angles, and are fixed to the shafts of the PF roller 51*a* and the roll 51*b* respectively. The encoders 11*a* and 11*b* are fixed at the positions on the outer peripheral portions of the encoder coded plates 12*a* and 12*b*, respectively, at which the encoders 11*a* and 11*b* do not obstruct the rotation of the encoder coded plates 12*a* and 12*b*. The encoders 11*a* and 11*b* output pulses corresponding to the number of slits having crossed the encoders 11*a* and 11*b* as the PF roller 51*a* rotates, thereby outputting information indicating the position (rotation angle) of the PF roller 51*a*.

The processor 20 is provided with a CPU, a RAM, a ROM, and the like (not illustrated), and can execute a program stored in the ROM or the like. Needless to say, the processor 20 may have various configurations, and an ASIC or the like may be used. The processor 20 controls respective sections of the printing apparatus 100 by executing the program.

The processor 20 is able to control various types of control objects in the printing apparatus 100. In this case, the control of printing and the control for bringing the print length close to a reference length will be mainly described. The reference length is a reference length of a print product that is printed based on image data to be printed. When the program for the above control is executed, the processor 20 functions as a control unit 21. In the control of printing, the control unit 21 carries out image processing based on image data representing an object to be printed, so as to specify a color of ink, a droplet size of ink, and the like to be ejected on the printing medium 50 for each pixel. Based on the processing result, the control unit 21 acquires target positions in time series of the PF motor 1*a*, the RP motor 1*b* and the CR motor 4, and a drive timing of the head 3*a*; these are necessary for printing with ink droplets on the printing medium 50.

In order to arrange the PF motor 1*a*, the RP motor 1*b*, and the CR motor 4 at the respective target positions, the control unit 21 indicates control targets to the motor control unit 6 so as to the PF roller 51*a* and the roll 51*b* be driven, and the carriage 3 be driven.

That is, the control unit 21 outputs, to the motor control unit 6, the target position (target rotation angle) for the time-series PF motor 1*a* required at the time of transporting the printing medium 50 by rotating the PF roller 51*a*. The motor control unit 6 outputs a current value for moving the PF motor 1*a* to the above-mentioned target position. Based on the current value, the PF motor driver 2*a* drives the PF motor 1*a* so that the PF motor 1*a* is set at the target position.

In this embodiment, a drive mechanism (not illustrated) is coupled to the PF roller 51*a*, and the control unit 21 is able to adjust a distance between the PF roller 51*a* and the driven roller 51*c* by giving an instruction to the drive mechanism. That is, the control unit 21 is able to adjust the pressure for pinching the printing medium 50 between the PF roller 51*a* and the driven roller 51*c*. In the present embodiment, a plurality of steps is provided as choices for the pressure in advance, and when the control unit 21 indicates any of setting values representing the choices, the drive mechanism pinches the printing medium 50 with the indicated pressure. Needless to say, the pressure may be controlled by feedback control. The drive mechanism may be implemented by various mechanisms; for example, it is possible to employ a configuration in which at least one of the shaft positions of the PF roller 51*a* and the driven roller 51*c* is moved by various components such as a motor and a solenoid, or a configuration in which a force acting on at least one of the shafts is adjusted by a gear mechanism.

Further, the control unit 21 outputs, to the motor control unit 6, the target position (target rotation angle) for the time-series RP motor 1*b* required at the time of feeding out the printing medium 50 by rotating the roll 51*b*. The motor control unit 6 outputs a current value for moving the RP motor 1*b* to the above target position. Based on the current value, the RP motor driver 2*b* drives the RP motor 1*b* so that the RP motor 1*b* is set at the target position.

Further, the control unit 21 outputs, to the motor control unit 6, the target position for the time-series carriage 3 required at the time when the carriage 3 is made to perform main scanning. The motor control unit 6 outputs a current value for moving the carriage 3 to the target position. Based on the current value, the CR motor driver 5 drives the CR motor 4 so that the carriage 3 is set at the target position.

Further, the control unit 21 performs the control for recording with ink droplets on the printing medium 50 at the drive timing of the head 3*a* obtained by the image processing. That is, the control unit 21 outputs, to the head driver 7, the drive timing of the head 3*a* and an amount of ink droplet (ink dot size) at each drive timing. The head driver 7 generates a voltage for ejecting the above-mentioned amount of ink droplet at the drive timing, and supplies the voltage to each head 3*a*. The head 3*a* in the carriage 3 is driven by the above-mentioned voltage to eject ink droplets so as to perform printing on the printing medium 50.

In addition, in the present embodiment, the printing medium 50 is attached to the platen in order to prevent a position shift or the like of the ink droplet due to floating of the printing medium 50. For this purpose, the control unit 21 indicates an attachment force to the attachment unit driver 60. The attachment unit driver 60 generates electric power for driving the attachment units 61 and 62 with the attachment force, and drives the attachment units 61 and 62. As a result, the printing medium 50 is attached to the platen with the attachment force indicated by the control unit 21. In the present embodiment, a plurality of steps is provided as choices for the attachment force in advance, and when the control unit 21 indicates any of setting values representing the choices, the drive mechanism sucks the printing medium 50 with the indicated attachment force. Needless to say, the pressure may be controlled by feedback control.

In the present embodiment, printing is performed by sequentially carrying out the transportation of the printing medium 50, the transportation of the carriage 3, and the ejection of ink droplets from the head 3*a*, in a state of the printing medium 50 being attached to the platen. In such printing, in order to prevent the print length from being shifted from the reference length, it is necessary for the printing medium 50 to be accurately transported. Accordingly, the motor control unit 6 of the present embodiment controls the PF motor 1*a*, the RP motor 1*b*, and the CR motor 4 by feedback control.

Figure 3:
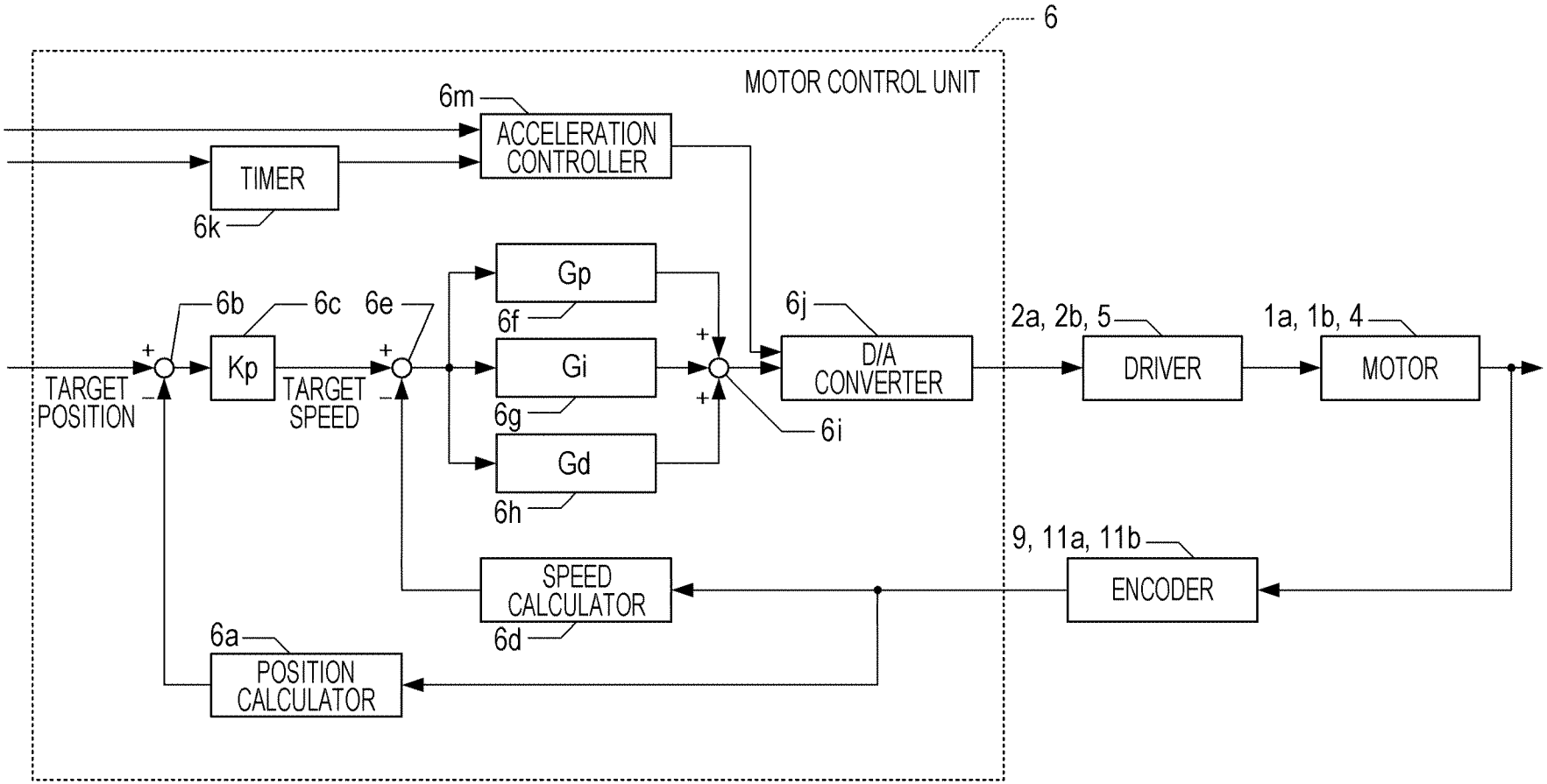
FIG. 3 is a diagram illustrating a configuration of a motor control unit.

FIG. 3 is a block diagram illustrating a configuration of the motor control unit 6. In the motor control unit 6, although three sets of circuits which are substantially the same are provided for controlling each of the PF motor 1*a*, the RP motor 1*b*, and the CR motor 4 (however, control parameters may be different), the description will be given hereinafter without distinguishing them. The motor control unit 6 includes a position calculator 6*a*, a subtractor 6*b*, a target speed calculator 6*c*, a speed calculator 6*d*, a subtractor 6*e*, a proportion element 6*f*, an integration element 6*g*, a differentiation element 6*h*, an adder 6*i*, a D/A converter 6*j*, a timer 6*k*, and an acceleration controller 6*m*.

The position calculator 6*a* detects the output pulses of the encoders 9, 11*a* and 11*b*, counts the numbers of detected output pulses, and calculates the positions of the carriage 3 and the PF motor 1*a* based on the counted values. The subtractor 6*b* calculates a positional deviation between the target position sent from the control unit 21 and the actual position of each of the carriage 3 and the PF motor 1*a* obtained by the position calculator 6*a*.

The target speed calculator 6*c* calculates the target speed of each of the carriage 3 and the PF motor 1*a* based on the positional deviation, which is the output of the subtractor 6*b*. This calculation is carried out by multiplying the positional deviation by a gain Kp. The gain Kp is determined in accordance with the positional deviation. The value of the gain Kp may be stored in a table (not illustrated).

The speed calculator 6*d* calculates the speed of each of the carriage 3 and the PF motor 1*a* based on the output pulses of the encoders 9, 11*a*, and 11*b*. The speed calculation may be carried out by various methods; for example, a method may be employed in which the speed calculator 6*d* counts a time interval between edges of the output pulses with a timer counter, and divides the distance between the edges by the count value of the timer counter, thereby carrying out the calculation. The subtractor 6*e* calculates a speed deviation between the target speed and the actual speed of each of the carriage 3 and the PF motor 1*a* calculated by the speed calculator 6*d*.

The proportion element 6*f* multiplies the speed deviation by a constant Gp, and outputs the multiplication result. The integration element 6*g* integrates a product of the speed deviation and a constant Gi. The differentiation element 6*h* multiplies a difference between the current speed deviation and an immediately previous speed deviation by a constant Gd, and outputs the multiplication result. The calculations in the proportion element 6*f*, the integration element 6*g*, and the differentiation element 6*h* are carried out every period of the output pulses of the encoders 9, 11*a* and 11*b*, that is, carried out in synchronization with a rising edge of the output pulse, for example.

The outputs by the proportion element 6*f*, integration element 6*g*, and differentiation element 6*h* are added in the adder 6*i*. The result of the addition, that is, a drive current for each of the PF motor 1*a* and the CR motor 4 is sent to the D/A converter 6*j* and converted to an analog current. Based on the analog voltage, the PF motor 1*a* and the CR motor 4 are driven by the PF motor driver 2*a* and the CR motor driver 5, respectively.

The timer 6*k* and the acceleration controller 6*m* are used for acceleration control, and the PID control using the proportion element 6*f*, the integration element 6*g*, and the differentiation element 6*h* is used for constant-speed and deceleration control during the acceleration.

The timer 6*k* generates a timer interrupt signal at every predetermined time based on a clock signal sent from the control unit 21. Each time the timer interrupt signal is received, the acceleration controller 6*m* integrates a predetermined current value (for example, 20 mA) on the target current value, and the integration result, that is, the target current value of each of the PF motor 1*a* and the CR motor 4 at the time of acceleration is sent to the D/A converter 6*j*. As in the case of PID control, the target current value is converted to an analog current by the D/A converter 6*j*, and the PF motor 1*a* and the CR motor 4 are driven by the PF motor driver 2*a* and the CR motor driver 5, respectively, based on the analog current.

In the present embodiment, the control unit 21 is able to control a tensile force applied to the printing medium 50 based on torque of the PF motor 1*a* with the above-discussed configuration (see FIG. 2). Specifically, the motor control unit 6 is able to acquire the torque of the PF motor 1*a* in operation. The torque may be acquired by various methods; in this embodiment, the motor control unit 6 acquires a current value supplied to the PF motor 1*a* by the PF motor driver 2*a*, and calculates the torque based on the current value. Needless to say, the torque may be detected by a sensor or the like.

In the present embodiment, the torque acting on the PF motor 1*a* and the tensile force applied to the printing medium 50 are in a predetermined relationship; the control unit 21 acquires the torque acting on the PF motor 1*a* from the motor control unit 6, and acquires the tensile force applied to the printing medium 50. Here, the tensile force applied to the printing medium 50 is a tensile force that is applied to the printing medium 50 existing between the PF roller 51*a* and the roll 51*b*.

When the tensile force is not a predetermined value, the control unit 21 instructs the motor control unit 6 to adjust the torque of the RP motor 1*b* via the RP motor driver 2*b*. In other words, when the tensile force is not the predetermined value, the control unit 21 calculates a target position of the RP motor 1*b* for making the tensile force be the predetermined value, and outputs the calculated target position to the motor control unit 6. When the target position is output, the motor control unit 6 controls the RP motor 1*b* to take the target position. As a result, the torque of the RP motor 1*b* is changed, and feedback control is performed so that the tensile force takes the predetermined value.

In the present embodiment, a plurality of steps is provided in advance as choices of predetermined values indicating tensile forces, and the control unit 21 calculates a target position of the RP motor 1*b* in such a manner that the tensile force corresponds to any of the choices, and indicates the calculated target position to the motor control unit 6. That is, in the present embodiment, the tensile force to be applied to the printing medium 50 may be set to any of the plurality of steps.

In the present embodiment, as discussed above, the detection of the tensile force (detection of the torque) and the control can be performed at a predetermined frequency. To be specific, the control unit 21 selects any of the predetermined choices, and acquires the torque of the PF motor 1*a* at a timing indicated by the choice. When the tensile force indicated by the torque is not a predetermined value, the control unit 21 performs feedback control so that the tensile force takes the predetermined value.

2. Determination of Setting Value of Transportation Mechanism

In the configuration described above, the transportation operation of the printing medium 50 can be changed by changing at least one of the pressure for pinching the printing medium 50 with the PF roller 51*a*, the tensile force applied to the printing medium 50 existing between the PF roller 51*a* and the roll 51*b*, the frequency of detection of the tensile force performed to control the tensile force, and the attachment force of the attachment units 61, 62 for attaching the printing medium 50 to the platen. In this embodiment, a value for setting each of these elements is referred to as a setting value of the transportation mechanism.

In this embodiment, the printing apparatus 100 can perform printing while selecting any type of printing medium from a plurality of types of printing media (for example, plain paper, photographic paper, cloth, and the like), and the printing apparatus 100 is shipped in a state in which a setting value of the transportation mechanism is determined in advance for each type of printing medium so that the printing apparatus 100 operates with the setting value corresponding to the printing medium at the time of printing.

However, when the setting value of the transportation mechanism is a fixed value, there may be such a case that the setting value is not an appropriate value in accordance with an environmental change of the printing apparatus 100, and aging variation of the PF motor 1*a*, the RP motor 1*b*, the CR motor 4, the timing belt 14, or the like. In this case, even when it is attempted to print an image so as to have a certain print length (reference print length), the print length of a print product obtained after printing may not be the reference print length. As such, in the present embodiment, a configuration is adopted in which the setting value of the transportation mechanism can be changed in such a manner that the print length is brought close to the reference.

2-1. Learning of Machine-Learned Model

In the present embodiment, the processor 20 refers to the machine-learned model acquired by machine learning, whereby a setting value of the transportation mechanism is determined. In the present embodiment, the machine-learned model is acquired by reinforcement learning. In other words, the printing apparatus 100 also functions as a learning device, the machine-learned model is learned for each type of printing medium, and printing is performed while referring to a learning model corresponding to a type of printing medium on which printing is performed. The reinforcement learning will be described below.

According to the present embodiment, as a result of the reinforcement learning, it is estimated that the precision of the print length will not be so improved as to be better than or equivalent to the current setting value by changing the setting value of the transportation mechanism, that is, it is possible to achieve a state in which the precision of the transportation position is assumed to be maximum. In the present embodiment, such a state is referred to as an optimized state, and the setting value of the transportation mechanism able to achieve the optimized state is referred to as a setting value of the optimized transportation mechanism.

In the present embodiment, the printing apparatus 100 functions as a learning unit 22 by executing a learning program. The learning unit 22 is able to observe state variables indicating a state of the printing apparatus 100. In this embodiment, the state variables are a print length as a length of a print product, and temperature and humidity around the printing apparatus 100. Specifically, the learning unit 22 controls the camera 8 to photograph the printing medium 50 from a print start position to a print end position while the carriage 3 being set at a specific position in the main scanning direction (for example, an endmost position in the main scanning direction where it is possible to photograph the printing range).

Then, the learning unit 22 measures the number of pixels in a region occupied by the print result (non-margin portion) of the captured image in the sub scanning direction, and specifies the print length based on the number of pixels. That is, in the present embodiment, since photographing is performed by the camera 8 in a state in which the printing medium 50 is attached to the platen, it is possible to define a correspondence relationship between the number of pixels in the captured image and the actual length of the image in advance.

The learning unit 22 acquires the print length from the image captured by the camera 8 based on the correspondence relationship. Needless to say, the print length may be specified by a variety of methods. For example, it may be measured by another sensor attached to the carriage 3 or another sensor attached to a portion other than the carriage 3, or may be measured by actually measuring the length of a portion printed on the printing medium 50 after printing. In the present embodiment, the learning unit 22 is able to observe state variables at any timing, that is, it is able to observe a print length, and the observed print length is recorded in a memory (not illustrated). Accordingly, it is possible to observe the print length when printing is performed in a state before the setting value of the transportation mechanism is changed, and the print length when printing is performed in a state after the setting value of the transportation mechanism is changed. Further, the learning unit 22 observes the temperature and humidity around the printing apparatus 100 based on the output of the temperature and humidity sensor 40.

In the present embodiment, since the reinforcement learning is adopted, the learning unit 22 determines an action for changing the setting value of the transportation mechanism based on the state variables, and carries out the determined action. When a reward is evaluated in accordance with a state after the action, an action value of the action becomes known. Then, the learning unit 22 optimizes the setting value of the transportation mechanism by iterating the observation of the state variables, the determination of the action in accordance with the state variables, and the evaluation of the reward obtained by the action.

Figure 4:
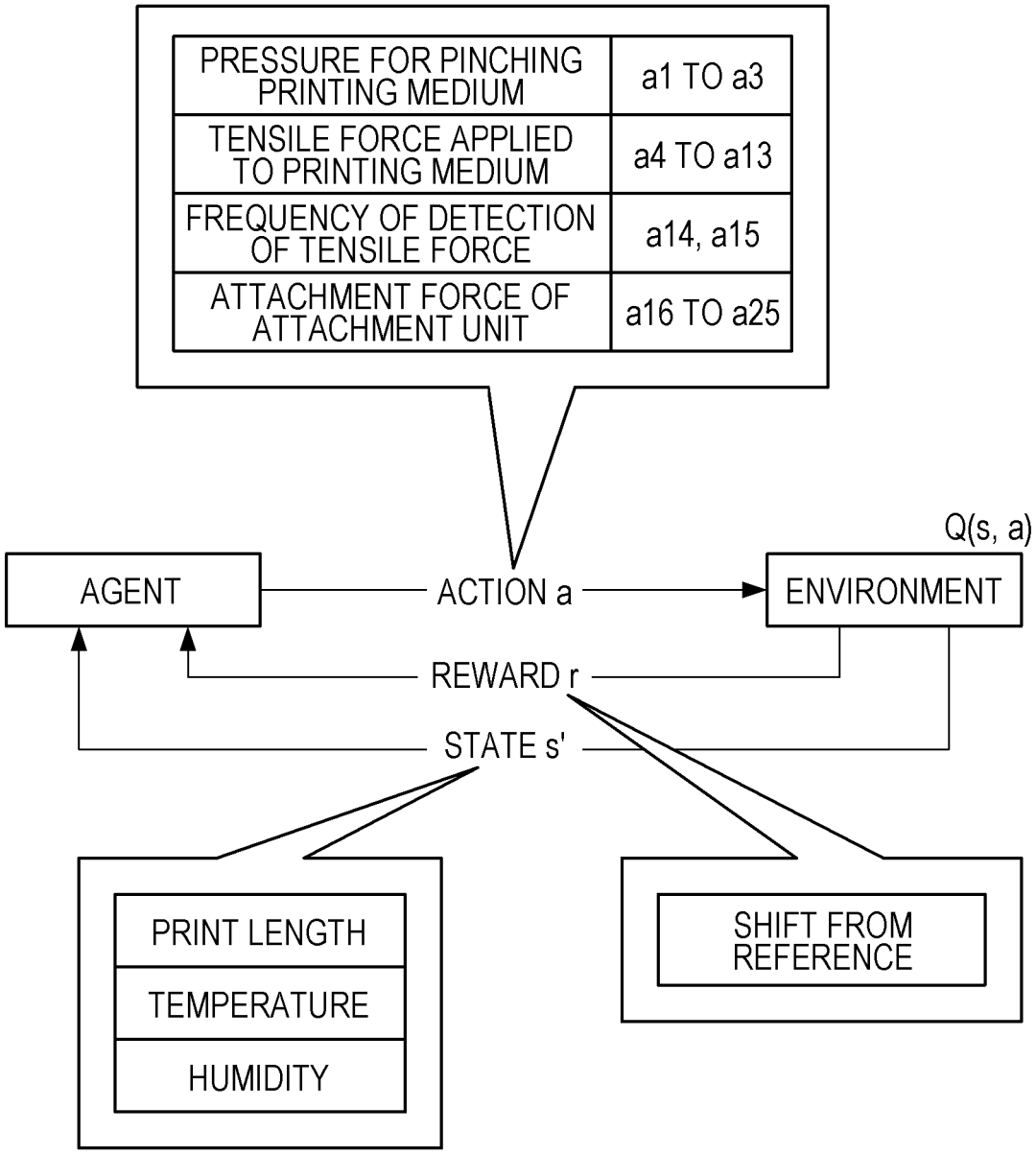
FIG. 4 is a diagram illustrating an example of learning by reinforcement learning.

FIG. 4 is a diagram for explaining a learning example of a setting value of a transportation mechanism according to a reinforcement learning model constituted of an agent and an environment. The agent illustrated in FIG. 4 corresponds to a function of selecting an action "a" in accordance with a predetermined strategy. The environment corresponds to a function of determining a next state s' based on the action a selected by the agent and a current state s, and determining an immediate reward r based on the action a, the state s, and the state s'.

In the present embodiment, Q learning is employed in which the learning unit 22 selects an action a by a predetermined strategy, and iterates process of updating a state, thereby calculating an action value function Q(s, a) of a certain action a in a certain state s. In other words, in this example, the action value function is updated by the following expression (1). When the action value function Q(s, a) has properly converged, the action a that maximizes the action value function Q(s, a) is regarded as an optimum action, and the setting value of the transportation mechanism indicating the action a is regarded as an optimized parameter.

$$Q(s_t,a_t)\leftarrow Q(s_t,a_t)+\alpha(r_{t+1}+\gamma\max_a Q(s_{t+1},a')-Q(s_t,a_t)) \quad (1)$$

Here, the action value function Q(s, a) is an expected value of a profit (a discount reward total sum in this example) to be obtained over the future when the action a is taken in the state s. The reward is r, and the subscript t of the state s, the action a and the reward r is a number (referred to as a trial number) representing one step in the trial process iterated in time series, and the trial number is incremented when the state changes after the action is determined. Therefore, the reward $r_{t+1}$ in the expression (1) is a reward obtained when the action $a_t$ is selected in the state $s_t$ and then the state comes to be $s_{t+1}$. Here, $\alpha$ is a learning rate, and $\gamma$ is a discount rate. Further, a' is an action that maximizes the action value function $Q(s_{t+1}, a_{t+1})$ in the action $a_{t+1}$ which can be taken in the state $s_{t+1}$, and $\max_a Q(s_{t+1}, a')$ is an action value function maximized by the action a' being selected. Intervals between trials may be determined by various methods; for example, a configuration in which trials are carried out at regular time intervals may be adopted.

In the learning of the setting value of the transportation mechanism, changing the setting value of the transportation mechanism corresponds to determining the action, and information indicating the setting value of the transportation mechanism as a learning object and also indicating actions that may be taken is recorded beforehand in the storage unit 30. In FIG. 4, an example is described in which a pressure for pinching the printing medium 50 with the PF roller 51*a*, a tensile force applied to the printing medium 50, a frequency of detection of the tensile force, attachment forces of the attachment units 61 and 62 are learning objects among setting values for the transportation mechanism.

The action in the example illustrated in FIG. 4 is an action to select one of the setting values prepared as choices in advance. In FIG. 4, an example is assumed in which the pressure for pinching the printing medium 50 with the PF roller 51*a* can be set to any of three steps (a1 to a3). Further, in the example illustrated in FIG. 4, the tensile force to be applied to the printing medium 50 can be set to any of ten steps (a4 to a13), and the frequency of detection of the tensile force can be set to any of two steps (a14, a15) (for example, every fixed period, every printing job, or the like). Furthermore, in the example illustrated in FIG. 4, the attachment force of each of the attachment units 61 and 62 can be set to any of ten steps (a16 to a25). Note that these examples are illustrative, the number of choices may be larger or smaller, and the number of actions may be increased or decreased from the current setting values. In the present embodiment, information for specifying each action (an action ID, a setting value in each action, and the like) is recorded in the storage unit 30.

In the example illustrated in FIG. 4, the reward is specified based on a shift of the print length from the reference. In the present embodiment, the shift from the reference is specified based on the image captured by the camera 8 indicating the print length. That is, the learning unit 22 specifies the print length based on the image obtained by photographing the printing medium 50 from the print start position to the print end position with the camera 8. There is an expected value for the print length of the print product, and the expected value is a reference print length.

Therefore, the learning unit 22 acquires a difference $\Delta Z$ between the print length of the print product and the reference print length as a shift from the reference. Further, the shift from the reference may be evaluated at a plurality of positions in the main scanning direction or may be statistically evaluated. In any case, the learning unit 22 sets a reward in such a manner that the reward becomes larger as the shift $\Delta Z$ from the reference is smaller (for example, $1/\Delta Z$ or the like).

The reward may be defined by various methods. For example, the reward may be +1 when the shift $\Delta Z$ is smaller than a threshold value, and may be −1 when the shift $\Delta Z$ is larger than the threshold value; other various definitions may also be employed. Further, the reward is not limited to a configuration where it is specified by a print length (total length) of the entire print product, and may be configured to be specified by a partial print length of the print product in the process of printing.

The next state s' when the action a is adopted in the current state s, can be specified by operating the printing apparatus 100 after having changed a parameter as the action a, and observing the state variables by the learning unit 22. That is, the learning unit 22 observes the print length printed in a state after having changed the setting value of the transportation mechanism, and observes the temperature and humidity around the printing apparatus 100 based on the output of the temperature and humidity sensor 40, thereby acquiring values indicating these information as state variables.

2-2. Example of Learning of Transportation Mechanism Setting Value

Next, an example of learning of a setting value of the transportation mechanism will be described. The information indicating variables and functions to be referred to in the process of learning is stored in the storage unit 30. To be specific, a configuration is employed in which the learning unit 22 causes an action value function Q(s, a) to converge by iterating observation of state variables, determination of an action corresponding to the state variables, and evaluation of a reward obtained by the action. Therefore, in this example, time-series values of the state variables, actions, and rewards in the learning process are sequentially recorded in the storage unit 30.

The action value function Q(s, a) may be calculated by various methods, and may be calculated based on a large number of times of trials; in the present embodiment, Deep Q-Network (DQN), which is a method of approximately calculating the action value function Q(s, a), is employed. In DQN, the action value function Q(s, a) is estimated by using a multilayer neural network. In this example, the multilayer neural network is employed in which the state s is taken as input, and a value of the action value function Q(s, a) of N number of actions that are selectable is taken as output.

Figure 5:
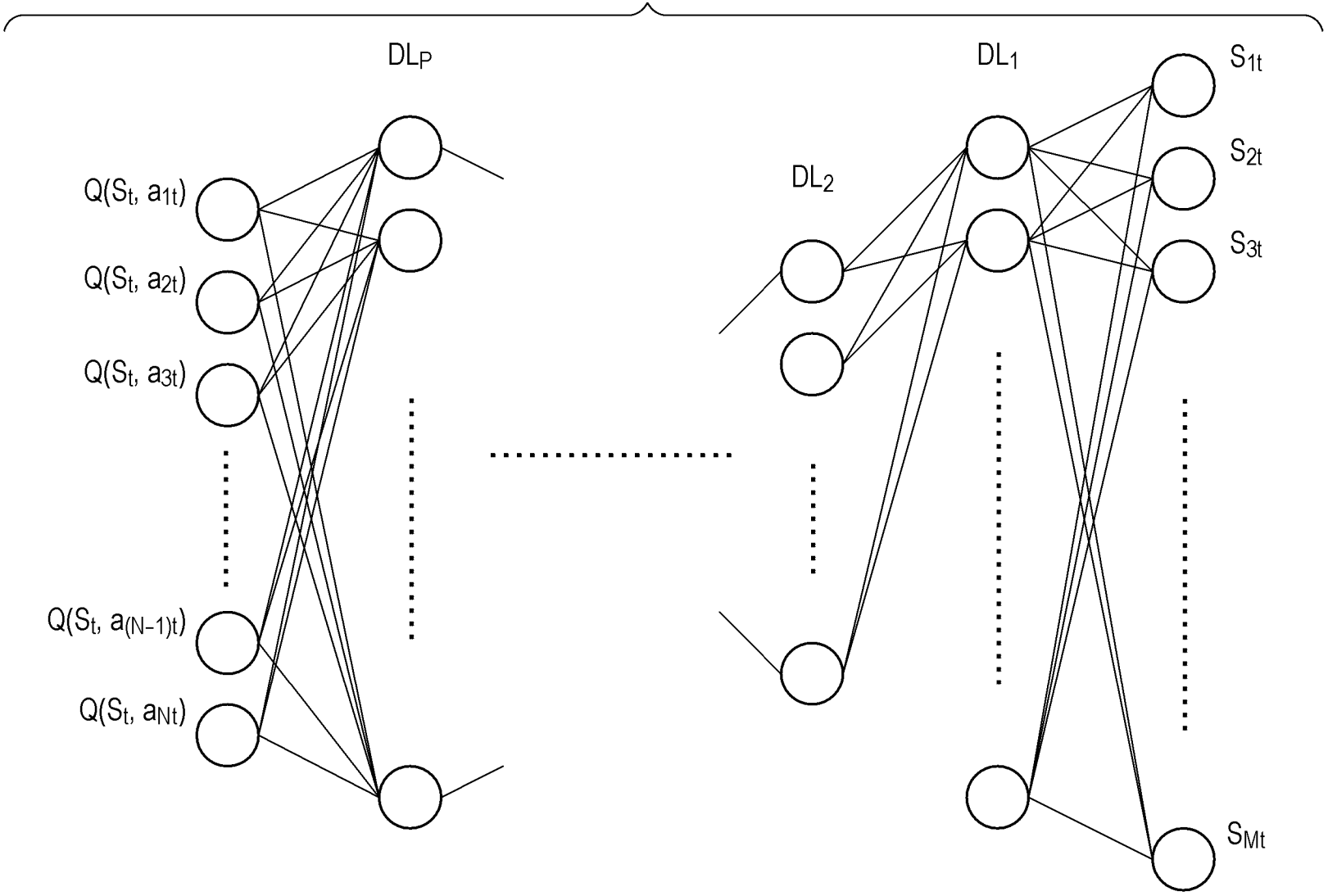
FIG. 5 is a diagram illustrating an example of a multilayer neural network.

FIG. 5 is a diagram schematically illustrating a multilayer neural network employed in this example. In FIG. 5, the multilayer neural network takes M number of state variables, M being an integer equal to or greater than 2, as input, and takes the vales of N number of action value functions Q, N being an integer equal to or greater than 2, as output. For example, in the example illustrated in FIG. 4, since there exists a total of three state variables, that is, print length, and temperature and humidity around the printing apparatus 100, M equals three, and the values of M number of state variables are input to the multilayer neural network. In FIG. 5, M number of states at a trial number t are represented as $s_{1t}$ to $S_{Mt}$.

In this example, an example in which one printing operation is performed in one trial is assumed, but a plurality of times of trials may be carried out in the process of one printing operation. In this case, the print length is a length of a portion printed in one trial, and the reward is a shift of the print length of the above portion from the reference. In this case, an overall print length when one printing operation is completed may be observed as a state variable and may be regarded as a reward, and this reward may have a larger weight than the reward in the printing process.

"N" is the number of selectable actions a, and the output of the multilayer neural network is a value of the action value function Q when a specific action a is selected with the state s being input. In FIG. 5, the action value function Q in each of the actions $a_{1t}$ to $a_{Nt}$ that are selectable at the trial number t is represented as $Q(s_t, a_{1t})$ to $Q(s_t, a_{Nt})$. "$s_t$" included in the Q is a character representatively indicating the states $s_{1t}$ to $S_{Mt}$ being input. In the example illustrated in FIG. 4, since 25 actions are selectable, N equals 25. The contents and the number (value of N) of actions a and the contents and the number (value of M) of states s may be changed in accordance with the trial number t.

The multilayer neural network illustrated in FIG. 5 is a model in which, at each node in each layer, input of an immediately preceding layer (the state s in the first layer) is multiplied by a weight w and a bias b is added thereto, and an arithmetic operation for obtaining output (to be input to the next layer) via an activation function is executed as necessary. In this example, P number of layers DL, P being an integer equal to or greater than one, exist, and a plurality of nodes exists in each layer.

The multilayer neural network illustrated in FIG. 5 is specified by the weight w and bias b in each layer, the activation function, the order of layers, and the like. Accordingly, in the present embodiment, parameters for specifying the multilayer neural network (information necessary to obtain output from input) are recorded in the storage unit 30. In the learning, variable values (for example, the weight w and bias b) are updated among the parameters for specifying the multilayer neural network. In this case, a parameter of the multilayer neural network changeable in the learning process is denoted by θ. When the θ is used, the action value functions $Q(s_t, a_{1t})$ to $Q(s_t, a_{Nt})$ described above may also be expressed as $Q(s_t, a_{1t}; \theta_t)$ to $Q(s_t, a_{Nt}; \theta_t)$.

Figure 6:
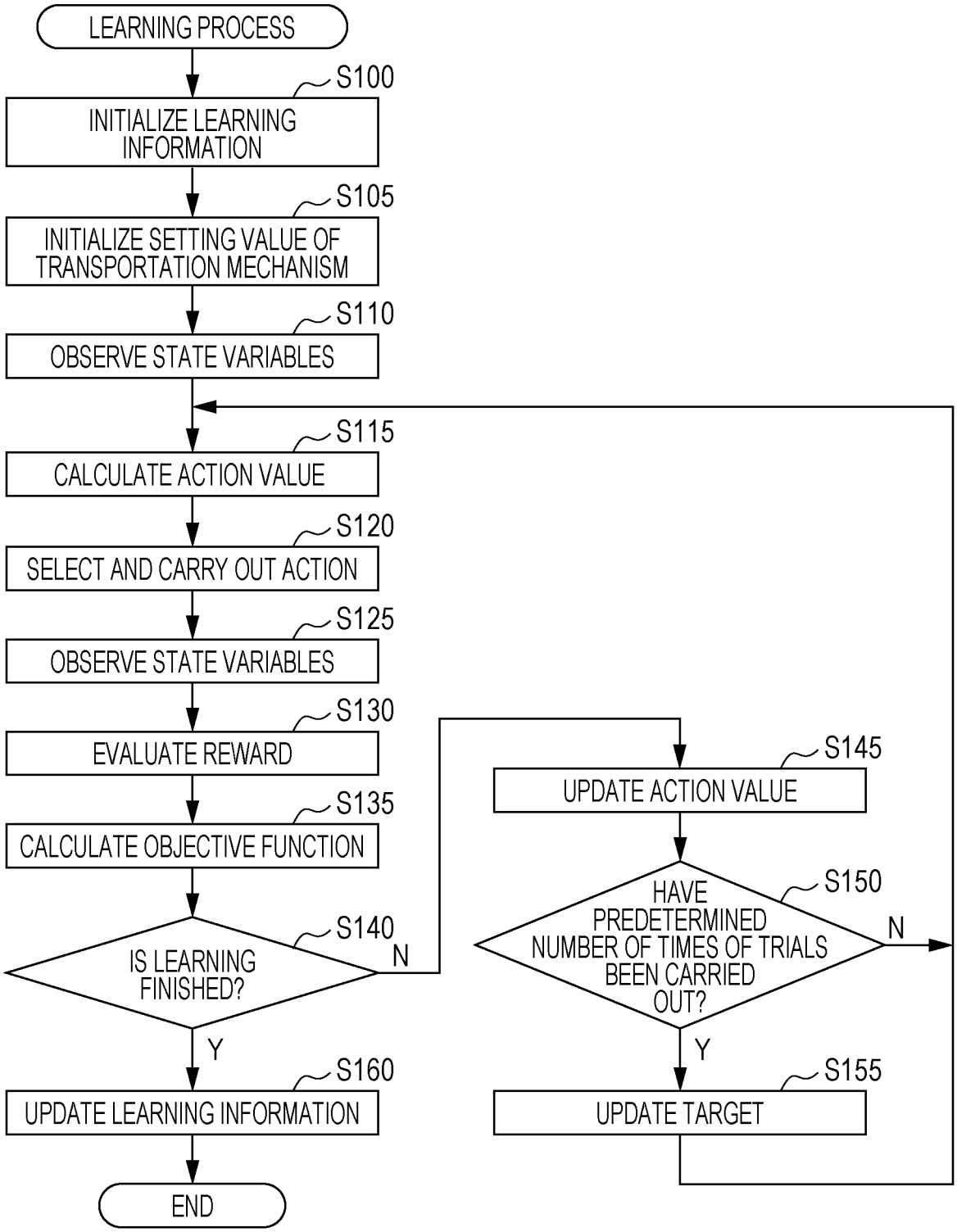
FIG. 6 is a flowchart of a learning process.

Next, a procedure of a learning process will be described with reference to a flowchart illustrated in FIG. 6. The learning process of a setting value of the transportation mechanism is carried out for each type of the printing medium 50 in the printing apparatus 100. When the learning process is started, the learning unit 22 initializes learning information (step S100). That is, the learning unit 22 specifies an initial value of θ to be referred to when the learning is started. The initial value may be determined by various methods; for example, when the learning was not carried out in the past, an any value, a random value, or the like may be the initial value of θ.

When the learning was carried out in the past, θ of the trained learning is adopted as the initial value. In addition, when learning with regard to a similar condition (a type of the printing medium 50 or the like) was carried out in the past, θ of the learning in the past may be taken as the initial value. The past-learning may have been carried out by a user using the printing apparatus 100, or may have been carried out before the manufacturer of the printing apparatus 100 sold the printing apparatus 100. In such case, the configuration may be such that the manufacturer prepares a plurality of sets of initial values in accordance with types of objects and work, and the user selects the initial value when the user carries out the learning. When the initial value of θ is determined, the stated initial value, which is taken as the current value of θ, is stored in the storage unit 30 as learning information.

Next, the learning unit 22 initializes the setting value of the transportation mechanism (step S105). To be specific, in such a manner that the setting value used when the printing apparatus 100 was last driven is taken, the learning unit 22 sets the pressure for pinching the printing medium 50 with the PF roller 51*a*, the tensile force applied to the printing medium 50 existing between the PF roller 51*a* and the roll 51*b*, the frequency of detection of the tensile force performed to control the tensile force, and the attachment force of the attachment units 61, 62 for attaching the printing medium 50 to the platen. At the time of an initial driving after shipment, the setting value of the transportation mechanism having been set at the time of shipment is set as the initial value. The setting value of the initialized transportation mechanism is stored in the storage unit 30 as a setting value of the current transportation mechanism.

Next, the learning unit 22 observes state variables (step S110). To be specific, the learning unit 22 indicates the setting value of the current transportation mechanism to the motor control unit 6 so as to the printing apparatus 100 be controlled with the setting value of the current transportation mechanism. The learning unit 22 acquires a print length and temperature and humidity around the printing apparatus 100, which are the state variables in a state after the control.

Next, the learning unit 22 calculates an action value (step S115). Specifically, the learning unit 22 acquires θ by referring to the learning information stored in the storage unit 30, inputs the latest state variables to the multilayer neural network indicated by the learning information stored in the storage unit 30, and calculates N number of action value functions $Q(s_t, a_{1t}; \theta_t)$ to $Q(s_t, a_{Nt}; \theta_t)$.

The latest state variables are observation results of step S110 at the first execution time and step S125 at the second and subsequent execution times. Further, the trial number t is equal to 0 at the first execution time, and equal to or greater than one at the second and subsequent execution times. When the learning process was not carried out in the past, since θ indicated by the learning information stored in the storage unit 30 has not been optimized, the value of the action value function Q may take an inaccurate value, but the action value function Q is gradually optimized by iterating process of step S115 and processes following step S115. During the iteration of the process of step S115 and the processes following step S115, the state s, action a, and reward r are stored in the storage unit 30 being associated with each trial number t, and can be referred to at any timing.

Next, the learning unit 22 selects and carries out an action (step S120). In the present embodiment, process is carried out in which the action a for maximizing the action value function Q(s, a) is regarded as an optimal action. Accordingly, the learning unit 22 specifies the maximum value among the values of N number of action value functions $Q(s_t, a_{1t}; \theta_t)$ to $Q(s_t, a_{Nt}; \theta_t)$ calculated in step S115. Then, the learning unit 22 selects the action that gives the maximum value. For example, when $Q(s_t, a_{Nt}; \theta_t)$ is the maximum value among the N number of action value functions $Q(s_t, a_{1t}; \theta_t)$ to $Q(s_t, a_{Nt}; \theta_t)$, the learning unit 22 selects the action $a_{Nt}$.

When the action is selected, the learning unit 22 changes the setting value of the transportation mechanism corresponding to the selected action. For example, in the example illustrated in FIG. 4, when the pressure a1 for pinching the printing medium 50 is selected, the learning unit 22 changes the pressure for pinching the printing medium 50 with the PF roller 51*a* to a1. When the change of the setting value of the transportation mechanism is made, the learning unit 22 refers to the setting value of the transportation mechanism and controls the printing apparatus 100 to perform printing.

Next, the learning unit 22 observes the state variables (step S125). Specifically, the learning unit 22 carries out the same process as that of observing the state variables in step S110, to acquire a print length and temperature and humidity around the printing apparatus 100 as the state variables. When the current trial number is t (when the selected action is $a_t$), the state s acquired in step S125 is $s_{t+1}$.

Next, the learning unit 22 evaluates a reward (step S130). To be specific, the learning unit 22 photographs the printing medium 50 from the print start position to the print end position with the camera 8, and specifies the print length of the print product based on the captured image. In addition, the learning unit 22 acquires, as a reference print length, a value expected to be a print length of the print product. Furthermore, the learning unit 22 acquires a difference ΔZ between the print length of the print product and the print length of the reference as a shift from the reference. Then, the learning unit 22 acquires a reward based on the shift ΔZ from the reference (for example, $1/\Delta Z$ or the like). When the current trial number is t, the reward r acquired in step S130 is $r_{t+1}$.

In the present embodiment, it is attempted to update the action value function Q represented by the expression (1), and in order to appropriately update the action value function Q, the multilayer neural network indicating the action value function Q must be optimized (optimization of θ). In order to properly output the action value function Q by the multilayer neural network illustrated in FIG. 5, teaching data serving as a target of the output is required. That is, by improving θ to minimize an error between the output of the multilayer neural network and the target, the multilayer neural network is expected to be optimized.

However, in the present embodiment, it is difficult to specify the target at a stage where the learning is not finished because of lack of knowledge on the action value function Q. Therefore, in the present embodiment, improvement of θ indicating the multilayer neural network is performed by an objective function that minimizes the second term in the expression (1), that is, a so-called Temporal Difference (TD) error. Specifically, $(r_{t+1}+\gamma\max_a Q(s_{t+1}, a'; \theta_t))$ is taken as a target, and θ is learned so that an error between the target and $Q(s_t, a_t; \theta_t)$ is minimized. Note that, since the target $(r_{t+1}+\gamma\max_a Q(s_{t+1}, a'; \theta_t))$ contains θ as a learning object, in this embodiment, the target is fixed over a certain number of times of trials (for example, fixed at θ having been learned last (fixed at the initial value of θ at the first learning time)). In the present embodiment, a predetermined number of times, which is the number of trial times during which the target is fixed, is determined in advance.

Since the learning is carried out on the premise discussed above, when the reward is evaluated in step S130, the learning unit 22 calculates an objective function (step S135). That is, the learning unit 22 calculates the objective function for evaluating a TD error in each trial (for example, calculates a function proportional to an expected value of the square of the TD error, the total sum of the squares of the TD errors, or the like). Since the TD error is calculated in a state where the target is fixed, when the fixed target is represented as $(r_{t+1}+\gamma\max_a Q(s_{t+1}, a'; \theta_))$, the TD error is $(r_{t+1}+\gamma\max_a Q(s_{t+1}, a'; \theta_) - Q(s_t, a_t; \theta_t))$. In the above expression of the TD error, the reward $r_{t+1}$ is a reward obtained by the action $a_t$ in step S130.

Further, $\max_a Q(s_{t+1}, a'; \theta_)$ is a maximum value among the outputs obtained when the state $s_{t+1}$ calculated by the action $a_t$ in step S125 is taken as input to the multilayer neural network specified by the fixed θ_. $Q(s_t, a_t; \theta_t)$ is an output value corresponding to the action $a_t$ among the outputs obtained when the state $s_t$ before the action $a_t$ is selected is taken as input to the multilayer neural network specified by the $\theta_t$ at the stage of the trial number t.

When the objective function is calculated, the learning unit 22 determines whether or not the learning is finished (step S140). In the present embodiment, a threshold value for determining whether or not the TD error is sufficiently small is predetermined, and when the objective function is equal to or smaller than the threshold value, the learning unit 22 determines that the learning is finished.

When it is not determined in step S140 that the learning is finished, the learning unit 22 updates the action value (step S145). To be specific, the learning unit 22 specifies a change in θ for reducing the objective function based on partial differentiation of the TD error by θ, and then changes the θ. Here, it is possible to change the θ by various methods; for example, a gradient descent method such as RMSProp may be adopted. Adjustment based on a learning rate or the like may also be performed as appropriate. According to the above-described process, it is possible to change the θ in such a manner that the action value function Q approaches the target.

However, in the present embodiment, since the target is fixed as described above, the learning unit 22 further determines whether or not to update the target. Specifically, the learning unit 22 determines whether or not a predetermined number of times of trials were carried out (step S150), and when it is determined in step S150 that the predetermined number of times of trials were carried out, the learning unit 22 updates the target (step S155). To be specific, the learning unit 22 updates the θ, which is referred to when the target is calculated, to the latest θ. Thereafter, the learning unit 22 iterates the process of step S115 and the processes following step S115. On the other hand, when it is not determined in step S150 that the predetermined number of times of trials were carried out, the learning unit 22 skips step S155 and iterates the process of step S115 and the processes following step S115.

When it is determined in step S140 that the learning is finished, the learning unit 22 updates the learning information stored in the storage unit 30 (step S160). Specifically, the learning unit 22 causes the storage unit 30 to store the θ obtained by learning as a machine-learned model 31, which is to be referred to when the printing apparatus 100 performs printing. When the machine-learned model 31 including the θ is stored in the storage unit 30, it is possible for the control unit 21 to acquire an optimized setting value of the transportation mechanism for the current printing apparatus 100 before printing.

3. Printing Process

Figure 7:
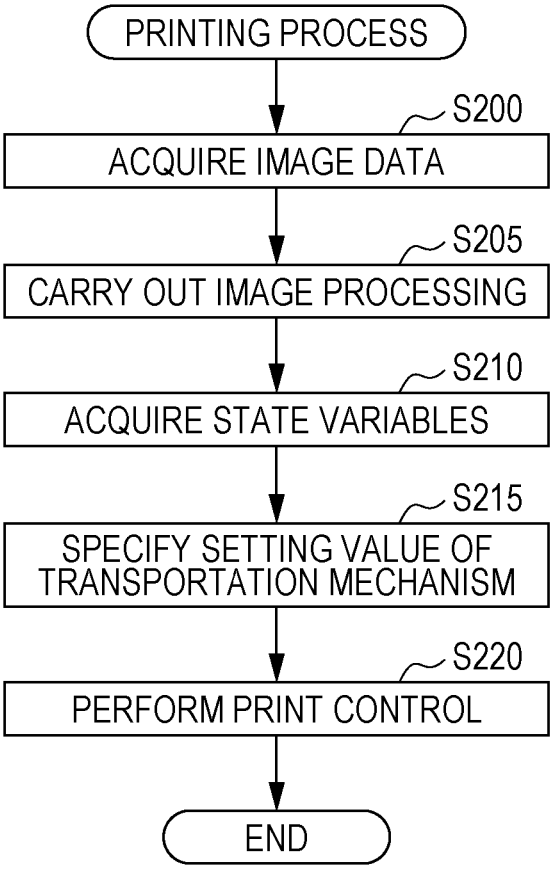
FIG. 7 is a flowchart of a printing process.

In a state in which the machine-learned model 31 is stored in the storage unit 30, the control unit 21 is able to control the printing apparatus 100 by making use of the optimized setting value of the transportation mechanism. FIG. 7 is a flowchart illustrating a printing process when printing is performed in the printing apparatus 100. The printing process is carried out in a state where a user designates image data stored in a computer, an external storage medium or the like (not illustrated) as an object to be printed, and also designates the type of the printing medium 50.

When the printing process is started, the control unit 21 acquires the image data (step S200). That is, the control unit 21 acquires the image data designated by the user from the computer, the external storage medium, or the like (not illustrated). Next, the control unit 21 carried out image processing (step S205). Specifically, the control unit 21 carries out the image processing for converting an image indicated by the image data into print data, in which the image is expressed by presence/absence of recording with ink droplets for each pixel. The image processing may employ a known technique; for example, it is achieved by color conversion processing gamma conversion processing, or the like.

Next, the control unit 21 acquires state variables (step S210). To be specific, the control unit 21 acquires a print length when printing was performed last in the printing apparatus 100, and acquires temperature and humidity around the printing apparatus 100 based on the output of the temperature and humidity sensor 40.

Next, the control unit 21 specifies a setting value of the transportation mechanism (step S215). Specifically, the control unit 21 refers to the machine-learned model 31, and calculates output Q(s, a) while taking the state variables acquired in step S210 as input. Further, the control unit 21 selects an action a that gives a maximum value in the output Q(s, a). When the action a is selected, the control unit 21 specifies the setting value of the transportation mechanism so that the setting value takes a value corresponding to the state in which the action a is carried out.

Next, the control unit 21 performs print control (step S220). Specifically, the control unit 21 sets a pressure for pinching the printing medium, a tensile force to be applied to the printing medium, a frequency of detection of the tensile force, and an attachment force of the attachment unit in such a manner as to be the setting value specified in step S215. Then, based on the data obtained in step S205, the control unit 21 acquires target positions in time series of the PF motor 1*a*, the RP motor 1*b* and the CR motor 4, and a drive timing of the head 3*a*; these are necessary for printing. In order to arrange the PF motor 1*a*, the RP motor 1*b*, and the CR motor 4 at the respective target positions, the control unit 21 indicates control targets to the motor control unit 6 so as to the PF roller 51*a* and the roll 51*b* be driven, and the carriage 3 be driven. As a result, printing is performed on the printing medium 50.

According to the above-discussed configuration, printing can be performed in a state where the action a, by which the action value function Q is maximized, is selected. The action value function Q is optimized as a result of iterating a large number of trials by the process described above. Therefore, according to the present embodiment, it is possible to optimize the setting value of the transportation mechanism with a higher probability than the setting value of the transportation mechanism that is manually determined.

Because the printing is performed with the optimized setting value of the transportation mechanism, the print length can be controlled to be close to the reference. Moreover, it is possible to maintain a state in which the print length is close to the reference for a long period of time.

4. Other Embodiments

The above-described embodiment is an example of carrying out the present disclosure, and various kinds of other embodiments may be employed. For example, the printing apparatus and the learning device may be complex equipment having a facsimile communication function or the like. Further, the printing apparatus and the learning device may be constituted of a plurality of devices. For example, a device in which the machine-learned model 31 is stored and a device in which printing is performed by the control unit 21 may be constituted by different devices.

Moreover, the printing apparatus and the learning device may be constituted by different devices. When the printing apparatus and the learning device are constituted by different devices, the learning device may carry out machine learning on the machine-learned model 31, which is applicable to a plurality of printing apparatuses, by collecting state variables from the plurality of printing apparatuses and causing each printing apparatus to carry out actions. A server may be cited as an example of the learning device. Some of the constituent elements in the above embodiment may be omitted, or the order of the process may be changed or omitted.

The printing apparatus includes a transportation mechanism for a printing medium. To be specific, the printing apparatus performs printing by transporting the printing medium and recording with a recording material on the printing medium that is transported. The transportation mechanism may be a variety of mechanisms; for example, a mechanism configured to transport a printing medium while pinching the printing medium with a roller, a mechanism configured to wind a printing medium by a roller, and a combination thereof may be employed. The printing medium may be a variety of media; that is, various kinds of media other than paper, such as a component of electronic equipment and an electric circuit board, may be used as a printing medium.

It is sufficient that the state variables include a print length, and other elements may be included in the state variables. The print length is a length of a print product along the transportation direction in which the printing medium is transported by the transportation mechanism, and is also a length from a print start position to a print end position along the transportation direction when an image is continuously printed on the printing medium. The elements which may become state variables also include an element that may become a setting value of the transportation mechanism. For example, the pressure for pinching the printing medium, the tensile force applied to the printing medium, or the like may be taken as a setting value (control target) of the transportation mechanism.

It is sufficient that the state variables indicate a state that can be obtained in accordance with a result of changing the setting value of the transportation mechanism, and they may be a numerical value, a flag, or a code meaning various kinds of states. It is sufficient that the machine-learned model is a mathematical model that outputs a setting value of the transportation mechanism by inputting the state variables thereto, and various kinds of models may be adopted in addition to the machine-learned model learned by the reinforcement learning.

Specifically, it is sufficient that the machine learning is a process of learning a better parameter using sample data, and a configuration may be adopted in which each parameter is learned by various methods, such as supervised learning and clustering, in addition to the reinforcement learning. The learning model is also not limited to the above embodiment; for example, it may be configured such that various kinds of neural networks such as Neural Network (NN), Convolutional Neural Network (CNN), and Recurrent Neural Network (RNN) are learned as a machine-learned model, or a model obtained by combining these models is learned as a machine-learned model.

It is sufficient that the setting value of the transportation mechanism is a value indicating a setting capable of varying the operation of the transportation mechanism, and it may be a numerical value, a flag, or a code indicating various kinds of states. In addition to the setting value in the above-described embodiment, various kinds of values may be adopted as a setting value; for example, a setting value such as a speed at which the printing medium is transported may be determined by the machine-learned model.

It is sufficient that the control unit performs printing by controlling the transportation mechanism with the setting value of the transportation mechanism acquired based on the machine-learned model. Accordingly, it is sufficient that the control unit changes the setting value of the transportation mechanism and operates the transportation mechanism in accordance with the changed setting value of the transportation mechanism, thereby transporting the printing medium and causing the printing apparatus to perform printing. Needless to say, various kinds of control may be performed as the control for printing; for example, various kinds of image processing may be carried out, and various kinds of control may be performed in accordance with the configuration of the printing apparatus, such as the presence/ absence of bidirectional printing, ink dot control, and adjustment of the amount of toner corresponding to the printing speed.

It is sufficient that the setting value in the transportation mechanism is a value for operating the transportation mechanism with the stated setting value, and a control mode when the setting value is set may take a variety of modes. For example, the pressure for pinching the printing medium may be feedback-controlled based on a detection result of a pressure sensor or the like, or a configuration to feedback-control the tensile force on the printing medium is omitted, but choices as setting values (for example, torque) capable of changing the tensile force are prepared in advance so that any of the above setting values is set; however, feedback-control may not be performed in this configuration. An action in the reinforcement learning may be any action that changes the setting value of the transportation mechanism. That is, a process that changes the setting value of the transportation mechanism in such a manner that control contents of a motor can be changed, is regarded as an action.

Further, in the learning process described above, the action value is updated by updating θ each time a trial is carried out, and the target is fixed until a predetermined number of times of trials are carries out; however, θ may be updated after a plurality of times of trials is carried out. For example, a configuration may be cited in which the target is fixed until a first predetermined number of times of trials are carried out, and θ is fixed until a second predetermined number of times (< the first predetermined number of times) of trials are carried out. In this case, θ is updated based on a sample corresponding to the second predetermined number of times of trials after the second predetermined number of times of trials are carries out, and the target is updated with the latest θ when the times of trials exceed the first predetermined number of times.

In the learning process, various known methods may be adopted; for example, experience reproduction or reward clipping may be performed. Furthermore, in FIG. 5, P number of layers DL are present, P being an integer equal to or greater than one, and a plurality of nodes exists in each layer, but the configuration of each layer can adopt various kinds of configurations. For example, various numbers of layers and various numbers of nodes may be adopted, various kinds of functions may be adopted as an activation function, and the network structure may be a convolution neural network structure or the like. The input and output modes are not limited to the example illustrated in FIG. 5; for example, there may be employed an example in which a configuration where the state s and the action a are input or a configuration where the action a that maximizes the action value function Q is output as a one-hot vector is at least used.

In the embodiment described above, by optimizing the action value function while carrying out trials in which the action is carried out with a greedy strategy based on the action value function, the greedy strategy with respect to the optimized action value function is considered to be an optimum strategy. This process is a so-called value iteration method, but the learning may be carried out by other methods such as a policy iteration method. Furthermore, various kinds of normalization may be performed on various kinds of variables such as the state s, action a, and reward r.

As a method of machine learning, various methods may be adopted, and trials with an ε-greedy strategy may be carried out based on the action value function Q. The method for reinforcement learning is not limited to the Q learning as described above, and a method such as SARSA may also be used. In addition, a method in which a model of the strategy and a model of the action value function are modeled separately such as the Actor-Critic algorithm, may be used. When the Actor-Critic algorithm is used, the following configuration may be employed: μ(s; θ), which is an actor indicating a strategy, and Q(s, a; θ), which is a critic indicating an action value function, are defined, an action is produced in accordance with the strategy in which noise is added to μ(s; θ) and a trial thereof is carried out, and the actor and the critic are updated based on the trial result, thereby learning the strategy and the action value function.

What is claimed is:

1. A printing apparatus including a transportation mechanism for a printing medium, the apparatus comprising:

a storage configured to store a machine-learned model that outputs a setting value of the transportation mechanism for causing, based on state variables including a print length as a length of a print product printed on the printing medium, the print length to be close to a reference; and a processor configured to perform printing by controlling the transportation mechanism in accordance with the setting value acquired based on the machine-learned model, wherein the learning of the machine-learned model is carried out in a manner in which, based on a reward which becomes larger as the shift of the print length from the reference is smaller, the setting values are optimized by iterating an observation of the state variables, the determination of an action for changing the setting value in accordance with the state variables, and evaluation of the reward obtained by the action.

2. The printing apparatus according to claim 1, wherein learning of the machine-learned model is carried out in a manner in which the state variables including the print length are observed, the action for changing the setting values including at least one of values of a pressure for pinching the printing medium with a transportation roller configured to pinch and transport the printing medium, a tensile force to be applied to the printing medium transported by the transportation mechanism, a frequency of detection of the tensile force performed for controlling the tensile force, and an attachment force of an attachment unit for attaching the printing medium to a predetermined position, is determined based on the observed state variables, and the setting values are optimized based on a shift of the print length from the reference.

3. The printing apparatus according to claim 1, wherein the state variables include at least one of temperature and humidity around the printing apparatus.

4. The printing apparatus according to claim 1, wherein the machine-learned model is learned for each type of the printing medium.

5. A learning device of a machine-learned model referred to in a printing apparatus provided with a transportation mechanism for a printing medium, the device comprising:

a learning unit configured to acquire a model, as the machine-learned model, that outputs a setting value of the transportation mechanism for causing, based on state variables including a print length as a length of a print product printed on the printing medium, the print length to be close to a reference, wherein the learning of the machine-learned model is carried out in a manner in which, based on a reward which becomes larger as the shift of the print length from the reference is smaller, the setting values are optimized by iterating an observation of the state variables, the determination of an action for changing the setting value in accordance with the state variables, and evaluation of the reward obtained by the action.

6. A learning method for a machine-learned model referred to in a printing apparatus that is provided with a transportation mechanism for a printing medium, the method comprising:

acquiring, as the machine-learned model, a model configured to output a setting value of the transportation mechanism for causing, based on state variable including a print length as a length of a print product printed on the printing medium, the print length to be close to a reference, wherein the learning of the machine-learned model is carried out in a manner in which, based on a reward which becomes larger as the shift of the print length from the reference is smaller, the setting values are optimized by iterating an observation of the state variables, the determination of an action for changing the setting value in accordance with the state variables, and evaluation of the reward obtained by the action.

* * * * *